United States Patent [19]

Sasaki et al.

[11] Patent Number: 4,840,500

[45] Date of Patent: Jun. 20, 1989

[54] THERMAL TRANSFER PRINTER HAVING AN IMPROVED THERMAL HEAD TO IMPROVE INK TRANSFER EVENESS

[75] Inventors: Akira Sasaki; Yoshihito Takahashi; Akiyoshi Hakoyama, all of Hitachi; Katsumasa Mikami, Ibaraki; Masafumi Suzaki; Takeo Honma, both of Hitachi; Tsuyoshi Yasutomi; Ryoichi Shiraishi, both of Kokubu; Yasuo Nishiguchi, Kyoto, all of Japan

[73] Assignee: Hitachi, Ltd., Tokyo, Japan

[21] Appl. No.: 76,849

[22] Filed: Jul. 23, 1987

[30] Foreign Application Priority Data

Jul. 30, 1986 [JP] Japan ..... 61-177540

[51] Int. Cl.[4] ..... B41J 3/20

[52] U.S. Cl. ..... 400/120; 219/216; 346/76 PH

[58] Field of Search ..... 400/120, 120 PH; 219/216, 216 PH; 346/76 PH

[56] References Cited

U.S. PATENT DOCUMENTS

| | | | |
|---|---|---|---|
| 4,472,723 | 9/1984 | Shibata | 400/120 PH X |
| 4,489,485 | 12/1984 | Tatsumi et al. | 219/216 PH |
| 4,528,572 | 7/1985 | Sasaki et al. | 400/120 X |
| 4,707,708 | 11/1987 | Kitagishi et al. | 219/216 PH |

FOREIGN PATENT DOCUMENTS

| | | | |
|---|---|---|---|
| 0118130 | 9/1984 | European Pat. Off. | 219/216 PH |
| 0161950 | 12/1979 | Japan | 400/120 PH |
| 0103863 | 6/1982 | Japan | 400/120 PH |
| 0024464 | 2/1983 | Japan | 400/120 PH |
| 0025975 | 2/1983 | Japan | 400/120 PH |
| 0059865 | 4/1983 | Japan | 400/120 PH |
| 0159365 | 9/1984 | Japan | 400/120 PH |

*Primary Examiner*—Ernest T. Wright, Jr.

*Attorney, Agent, or Firm*—Antonelli, Terry & Wands

[57] ABSTRACT

The face pressure distribution shape of the graze portion of the thermal head is made to be consistent with the temperature distribution shape of the graze portion of the thermal head. The temperature distribution shape of the graze portion of the thermal head is made to be consistent with the face pressure distribution shape of the graze portion of the thermal head. The graze portion of the thermal head is formed projectingly in two steps, and the heating resistor element of the thermal head is provided on the top portion of the graze portion of the thermal head. A thermal transfer printer having no ink void and no ink transfer unevenness can be obtained.

6 Claims, 8 Drawing Sheets

THERMAL TRANSFER PRINTER HAVING AN IMPROVED THERMAL HEAD TO IMPROVE INK TRANSFER EVENESS

BACKGROUND OF THE INVENTION

The present invention relates to a thermal transfer printer, and more particularly to a thermal transfer printer employing an ink ribbon coated with a thermal melting ink thereon or a heat sensitive paper.

In a conventional thermal transfer printer employing an ink ribbon, when a roughened surface paper such as a bond paper is used therein, the printing quality of the thermal transfer printer is undesirable because of an unevenness of ink transfer.

The inventors of the present invention have found an inconvenience in that the ink, which desirably is at the central portion of the printing dot, is missing when the face pressure of a thermal head against a platen is increased for improvement of the unevenness of ink transfer.

A conventional thermal head will be explained with reference to FIGS. 13–17. The thermal head 100 having a heating resistor element mounted on a projected top portion of a graze portion is disclosed in, for example, Japanese Patent Laid-Open No. 159365/1984. The conventional thermal head 100 comprises a head substrate member 101 and a graze portion 102 mounted on the surface of the head substrate member 101 as shown in FIG. 13.

The graze portion 102 is conventionally made of ceramics material and has a heating resistor element 103 at the top central portion or crown of a circular cross-sectionally shaped projection on the graze portion 102. The projection on graze portion 102 forms originally a shape illustrated by the curved broken line 104; however, the the graze portion 102 except for the projection containing the heating resistor element 103 has part of its surface removed as by an etching processing.

By this procedure the heating resistor element 103 is made to extend further from the surface of the graze portion 102. The horizontal width Wo of the heating resistor element 103 in the conventional thermal head 100 is made to be about 180 $\mu$m.

When the thermal head 100 having the above stated shape and installed in a printer of the type shown in FIG. 1, is pressed against a platen 19, the face pressure distribution of the graze portion 102 of the thermal head 100 is shown by line $P_o$ in FIG. 14.

All regions of the heating resistor element 103 of the graze portion 102 of the thermal head 100 have a high face pressure in comparison with the face pressure of the other portions of the thermal head 100. The raised portion of the heating resistor element 103 of the graze portion 102 is extended for the purpose of reducing printing unevenness. In FIG. 14, the broken line $T_o$ shows the temperature distribution of the heating resistor element 103 of the graze portion 102 of the thermal head 100.

The face pressure distribution $P_o$ of the heating resistor element 103 of the thermal head 100 has a region of increased pressure at both ends thereof as shown in FIG. 14 when compared with the central region thereof. The face pressure distribution $P_o$ of the heating resistor element 103 of the thermal head 100 extends substantially uniformly over all regions thereof, in comparison with the face pressure of the graze portion 102 except for the portion of the heating resistor element 103.

The temperature distribution of the heating resistor element 103 of the conventional thermal head 100 is shown in FIGS. 15 and 16 when the thermal head 100 is not pressed against the platen.

The curve line $T_{01}$ shown in FIG. 16 indicates the temperature distribution of the heating resistor element 103 of the thermal head 100. The temperature distribution of the heating resistor element 103 of the thermal head 100 shows a maximum temperature at the central portion and a temperature profile which indicates a lower temperature at opposite ends of the heating resistor element 103.

The contour lines $RL_o$ shown in FIG. 15 indicate isothermal curve lines of the heating resistor element 103 of the thermal head 100. The heating resistor element 103 of the thermal head 100 has the horizontal width $W_o$ and the lengthwise width $L_o$, respectively.

When printing is practiced by the thermal head 100 employing the above stated temperature distribution $T_o$ and the face pressure distribution $P_o$, ink is omitted from the central portion of the printing dot. Consequently, the printing dot $D_o$ becomes a doughnut-like dot as shown in FIG. 17 having an ink void in the center portion.

In the conventional thermal transfer printer as shown in FIG. 1, the face pressure distribution $P_o$ is substantially uniform over the region of the heating resistor element 103 in the thermal head 100. Also, the heat resistance of the heat transfer system extending over the heating resistor element 103, the ink ribbon 9 and the transfer recording paper 17 is substantially uniform. The central portion of the heating resistor element 103 of the thermal head 100 has a somewhat higher temperature indicated by FIGS. 15 and 16.

Because the central portion of the heating resistor element 103 of the thermal head 100 reaches a high temperature state, the ink at the central portion is melted but not transferred to the recording paper 17. Instead the central portion is cooled and allowed to solidify. The ink not at the central portion is transferred from the ink ribbon side to the transfer recording paper side and transferred onto the transfer recording paper 17.

In a the conventional thermal transfer printer, the ink of the central portion of the printing dot does not mark and the image has an unmarked hollow center as illustrated in FIG. 17. When the roughened surface paper 17 such as a bond paper is used, the face pressure of the graze portion of the thermal head is increased because of an unevenness of the transfer recording paper surface and the melted ink transfers unevenly into the paper making control of the printing density difficult. To obtain an increase in printing density, it has been necessary to increase the amount of ink required, thus requiring a concomitant increase in heat energy for the thermal head.

As stated above, in the conventional thermal transfer printer, there is a disadvantage in that the central portion of the printing dot remains in a white or ink void condition which detracts from the quality of the print.

SUMMARY OF THE INVENTION

An object of the present invention is to provide a thermal transfer printer wherein the ink void of the central portion of the printing dot can be eliminated.

Another object of the present invention is to provide a thermal transfer printer wherein the transfer unevenness can be avoided.

According to the present invention, a thermal transfer printer is provided which includes a platen and a thermal head, the thermal head including a head substrate member, a graze portion formed as a projection on the head substrate member, and a heating resistor element formed on a top portion of the graze portion. The thermal transfer printer may have an ink ribbon coated with a thermal melting ink thereon.

A temperature distribution curve line shape of a surface of the heating resistor element of the thermal head when the thermal head is not pressed against a platen side and a face pressure distribution curve of the surface of the heating resistor element of the thermal head when the thermal head is pressed against the platen side are made to have substantially analogous shapes.

The face pressure distribution curve of the graze portion of the thermal head is made to be consistent with the temperature distribution curve of the graze portion of the thermal head.

The temperature distribution curve of the graze portion of the thermal head is made to be consistent with the face pressure distribution curve of the graze portion of the thermal head.

The graze portion of the thermal head is formed with multisteps, and the heating resistor element of the thermal head is provided on the most top portion of the graze portion of the thermal head.

The graze portion of the thermal head is formed with two steps, and the heating resistor element of the thermal head is provided on the top portion of the graze portion of the thermal head. The top portion of the graze portion of the thermal head may have a width of about 100 μm.

According to the present invention, the thermal transfer printer having no ink void and no ink transfer unevenness can be obtained.

DETAILED DESCRIPTION OF THE INVENTION

Figure 1:
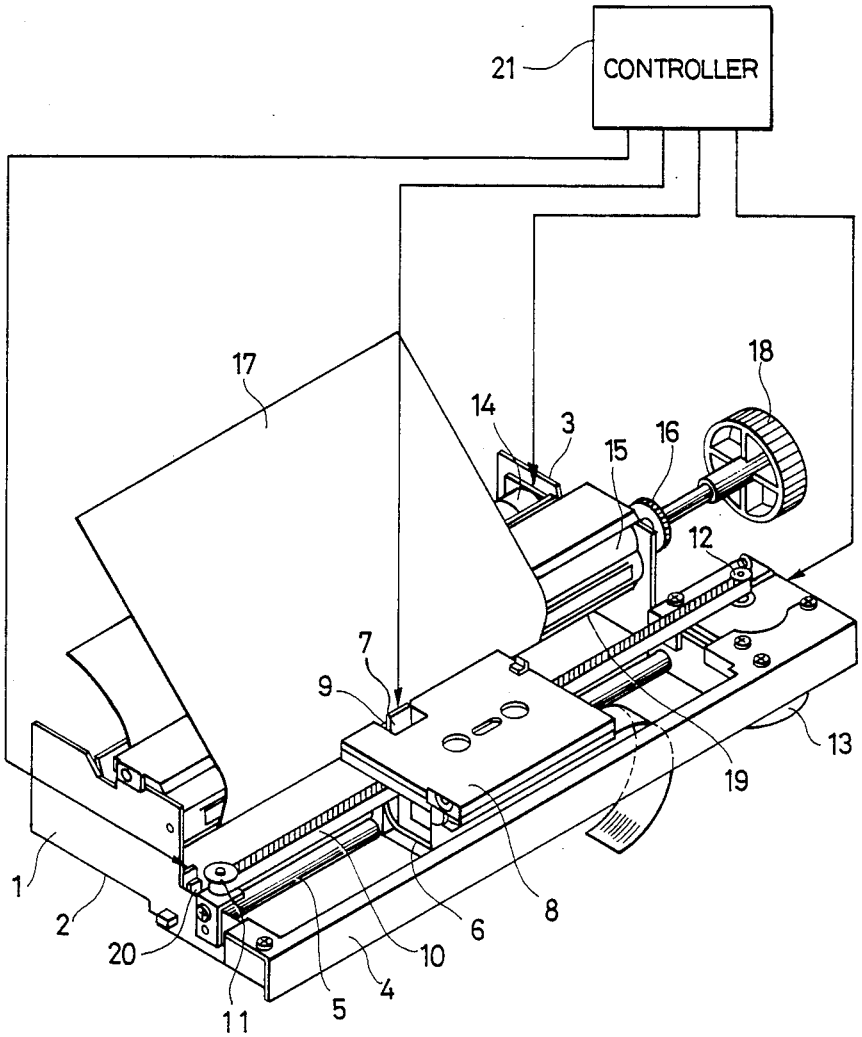
FIG. 1 is an outside appearance view of a thermal transfer printer that may have a prior art thermal head or a thermal head according to the present invention.

One embodiment of a thermal transfer printer having a thermal head according to the present invention will be described with reference to FIG. 1. FIG. 1 is an outside appearance view of a thermal transfer printer having a thermal head according to the present invention.

In the thermal transfer printer of the present invention, a frame 1 typically comprises side plates 2 and 3, and a front side plate 4. A shaft 5 is fixed between the side plates 2 and 3 of the frame 1. A carriage 6 is supported slidingly on the shaft 5. A thermal head 7 is mounted on the carriage 6. An ink ribbon cassette 8 is mounted detachedly on the carriage 7. An ink ribbon 9 is housed in the ink ribbon cassette 8.

A timing belt 10 is suspended over pulleys 11 and 12. The pulley 12 is driven by a carriage drive motor 13. The carriage drive motor 13 is mounted on the frame 1. The timing belt 10 is mounted on the carriage 6, so that the carriage 6 is adapted to move right and left by the rotation of the carriage drive motor 13.

A line feed motor 14 is mounted on the side plate 3 of the frame 1. A rotatable paper feed roller 15 is supported at opposite ends on the side plates 2 and 3 of the frame 1. The line feed motor 14 and the paper feed roller 15 are connected to each other by means including a gear 16. A transfer recording paper 17 is advanced by the paper feed roller 15. A platen knob 18 is provided with the paper feed roller 15, whereby the transfer recording paper 17 can be fed also by the platen knob 18. A flat platen 19 is located behind paper 17.

The thermal head 7 is adapted for engagement with the flat platen 19 through the transfer recording paper 17 and the ink ribbon 9. A home position sensor 20 is provided on the side plate 2 of the frame 1. A controller 21 controls the line feed motor 14, the carriage drive motor 13, the thermal head 7, and the home position sensor 20.

The thermal transfer printer of this embodiment of the present invention is such a printer of a one-way printing system in which the printing is practiced only while the carriage 6 is moved in the right direction. When the carriage 6 moves in the left direction, the printing is not practiced. Only when printing is practiced, does the thermal head 7 touch with the flat platen 19. The ink ribbon 9 is advanced only when the carriage 6 is moved in the right direction under the printing condition.

The printing motion is practiced when the line feed motor 14, the carriage drive motor 13, the thermal head 7, and the home position sensor 20 are controlled by the controller 21.

Figure 2:
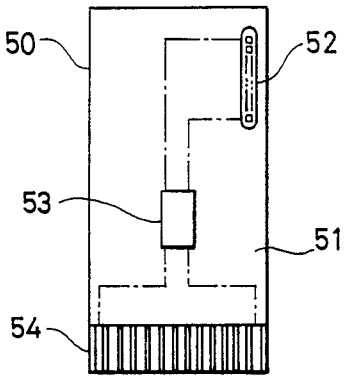
FIG. 2 is a view of the housing for a single head type thermal head according to the present invention.
Figure 3:
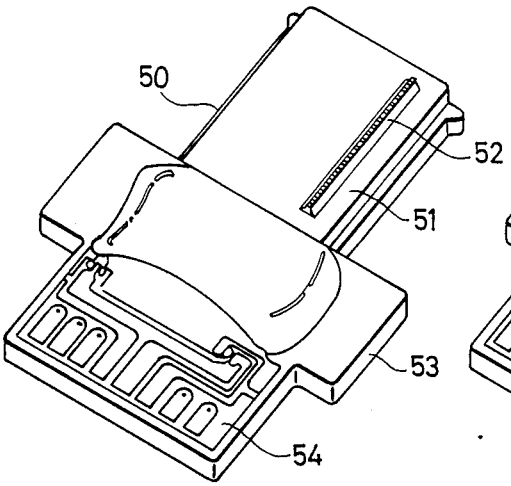
FIG. 3 is a perspective view of the single head type thermal head according to the present invention.

A thermal head 50 shown in FIGS. 2 and 3 is called a single head type thermal head. The single head type thermal head 50 includes a head substrate member 51 and a plurality of heating resistor elements 52 which are arranged longitudinally in a row. A drive circuit section 53 controls the electric supply to the heating resistor elements 52. The thermal head 50 receives operating power through a connector section 54 at one end thereof.

Figure 4:
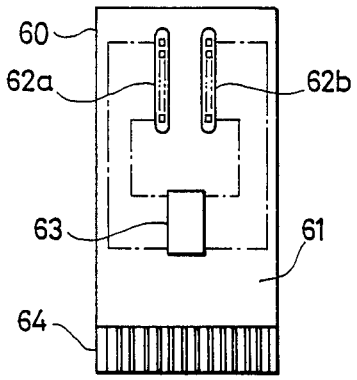
FIG. 4 is a view of the housing for a dual head type thermal head according to the present invention.
Figure 5:
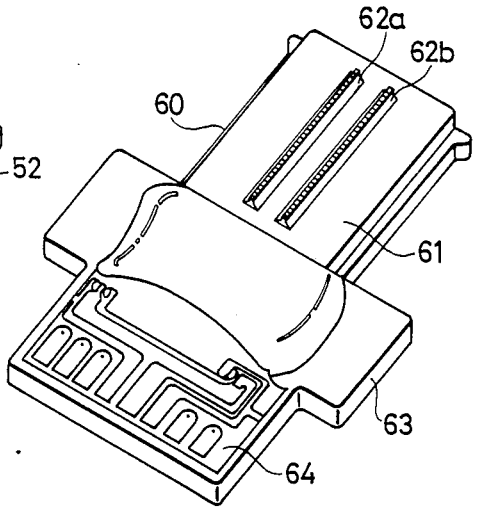
FIG. 5 is a perspective view of the dual heads type thermal head according to the present invention.

A thermal head 60 shown in FIGS. 4 and 5 is called a dual head type thermal head. The dual head type thermal head 60 includes a head substrate member 61 and two groups of heating resistor elements **62*a* and 62*b* which are arranged longitudinally in two rows. A drive circuit section 63 controls the electric supply to the heating resistor elements 62*a* and 62*b*. The thermal head 60 receives operating power through a connector section 64** at one end thereof.

Figure 6:
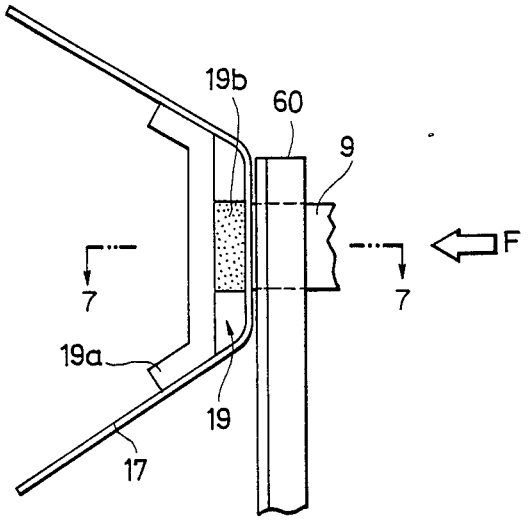
FIG. 6 is a side elevation showing the flat platen, the paper, the ribbon, and the thermal head portion according to the present invention.
Figure 7:
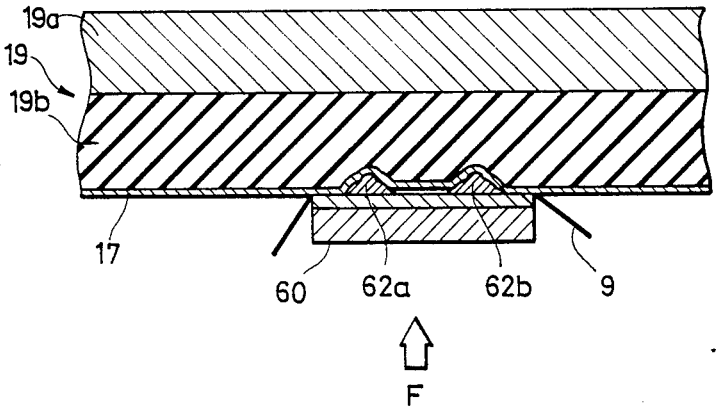
FIG. 7 is a plan view in section taken along line 7—7 of FIG. 6.

The flat platen 19 comprises a substrate member **19*a* and a rubber plate 19*b* as shown in FIGS. 6 and 7. The rubber plate 19*b* may be adhesively mounted on the front side of the substrate member 19*a*. The dual heads type thermal head 60 presses with a force (F) against the flat platen 19 during printing on the transfer recording paper 17**.

Figure 8:
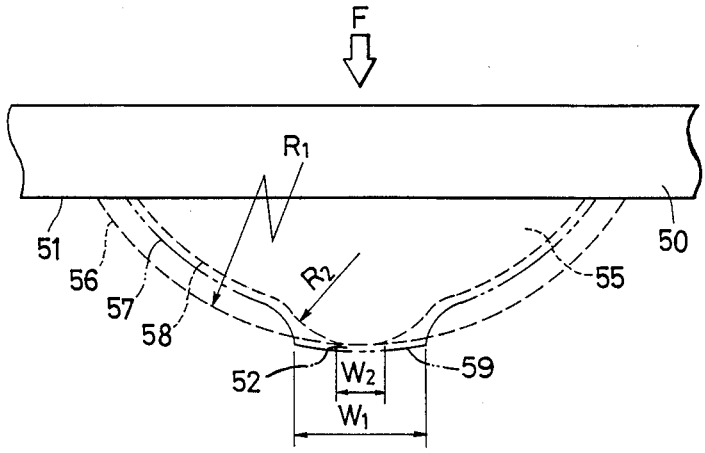
FIG. 8 is an enlarged plan view of the thermal head according to the present invention.

FIG. 8 shows single head type thermal head 50 in which the surrounding portion of the heating resistor element 52 is shown. The thermal head 50 comprises a head substrate member 51, a graze portion 55, and the heating resistor element 52. The graze portion 55 is formed on the head substrate member 51. The graze portion 55 is made of ceramic material. The graze portion 55 has the heating resistor element 52 on the side opposite the arrow F which points from the front toward the rear of the printer. The graze portion 55 has a semi-circular cross-sectional shape shown by the broken line 56 of FIG. 8 before being etched.

The graze portion 55 is etched to the broken line 57 portion by the first etching process. At this time, the width ($W_1$) of the top portion of the graze portion 55 is about 180 μm. The graze portion 55 is etched further to the broken line 58 by the second etching process. Then the width ($W_2$) of the top portion of the graze portion 55 is reduced to about 100 μm.

When the second etching process is practiced, the top portion of the graze portion 55 may be masked to be protected from the etching process. In the region of the width $W_1$ except for the width $W_2$, when the adhesive agent for the protection member is weak, the etching process can be practiced to the extent of the broken line 58 by only a one time etching process.

After the etching process is finished, the protection member 59 is removed, the heating resistor element 52 is provided by means of the vapor deposition method on the top portion of the graze portion 55. Before starting the vapor deposition for making the heat resistor element 52, the corners of both ends of the top portion or crown having a width $W_2$ are removed by means of a cutting method.

Thus the final shape of the top portion or crown of the graze 55 is formed to have a radius $R_2$. Since the radius of the top portion or crown of the graze portion 55 by the first etching processing is the radius $R_1$, the top portion of the graze portion 55 having the radius $R_2$ is referred to herein as a protuberance portion having a very small radius $R_2$.

Accordingly, the top portion or crown of the graze portion 55 provided with the heating resistor element 52 occupies the very narrow region, the combined structure of graze portion 55 and its crown comprising a two step or multi-step protuberance. It is thus possible to form the narrow region having a width W2 for the top portion or crown of the graze portion 55.

Figure 9:
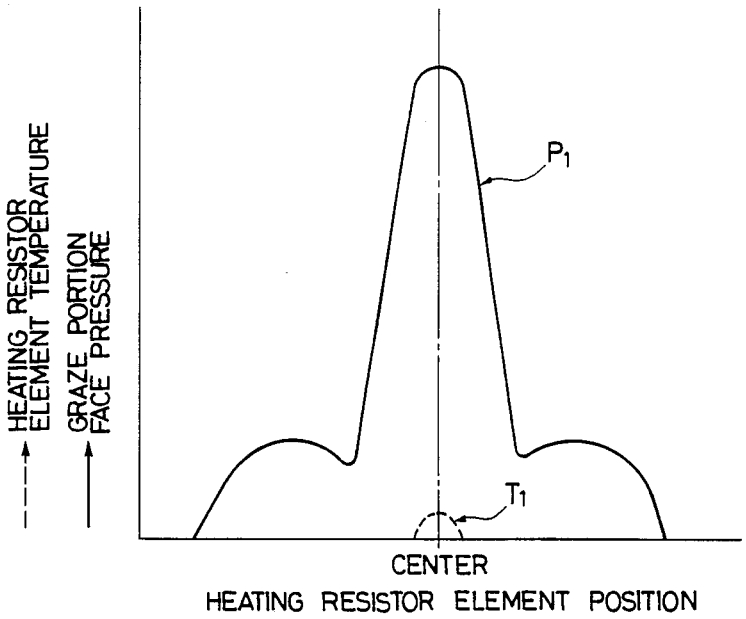
FIG. 9 includes graphs showing the temperature distribution and the face pressure distribution of the graze portion of the thermal head shown in FIG. 8 according to the present invention.
Figure 9A:
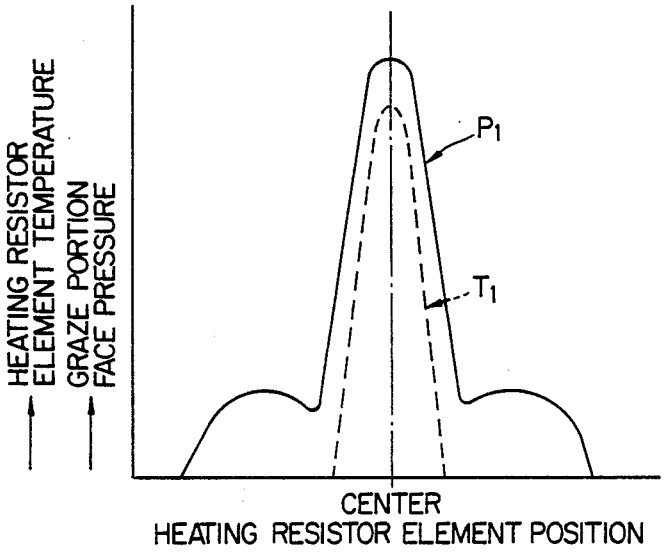
FIG. 9A contains the same graphs as FIG. 9 but with the scale of the temperature distribution curve expanded in the direction of the Y-axis.

FIG. 9 shows the relationship between the face pressure distribution $P_1$ and the temperature distribution $T_1$ of the graze portion 55 of the single head type thermal head 50 as shown in FIG. 8. At the crown having a small radius $R_2$ where the heating resistor element 52 is provided, the pressing or face pressure of the graze portion 55 against the flat rubber platen 19 rises abruptly as illustrated in FIG. 9 by the curve $P_1$. FIG. 9A shows the same relationship but with the scale of the temperature distribution curve $T_1$ enlarged in the direction of the Y-axis.

The temperature distribution $T_1$ of the graze portion 55 of the thermal head 50 has an analogous shape to that of the face pressure distribution curve $P_1$. The measurement of the temperature distribution $T_1$ of the graze portion 55 of the thermal head 50 is carried out when the thermal head 50 is not pressed against the flat rubber platen 19, namely during no printing.

Figure 13:
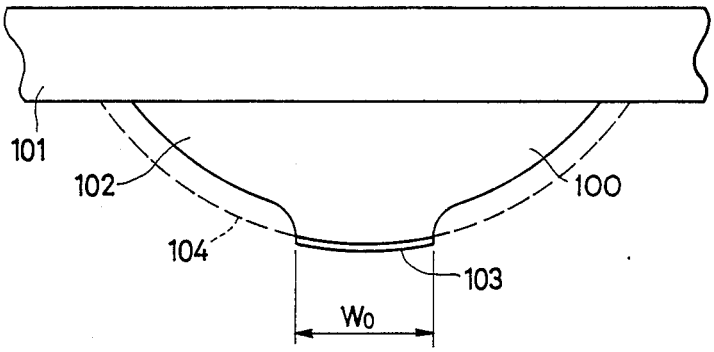
FIG. 13 PRIOR ART
FIG. 13 is an enlarged cross-sectional view of the thermal head according to prior art.
Figure 14:
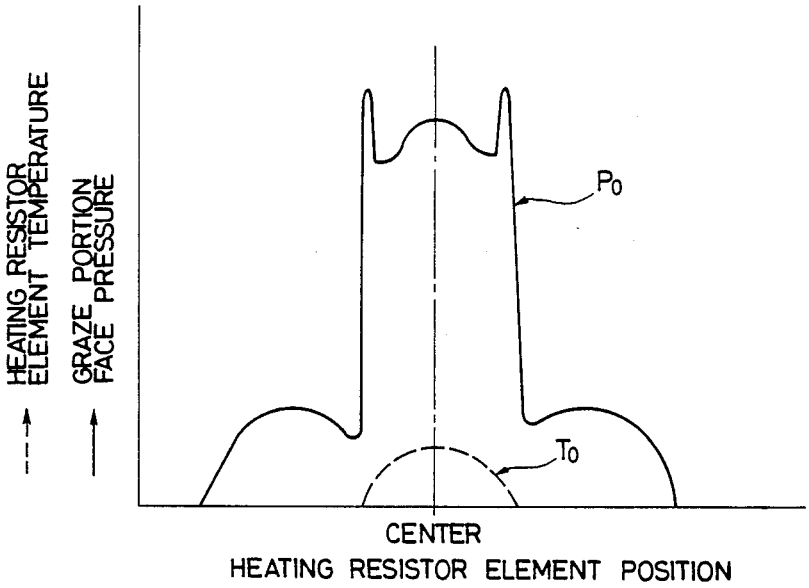
FIG. 14 PRIOR ART
FIG. 14 is a graph showing the temperature distribution and the face pressure distribution of the graze portion of the thermal head shown in FIG. 13 according to prior art.
Figure 15:
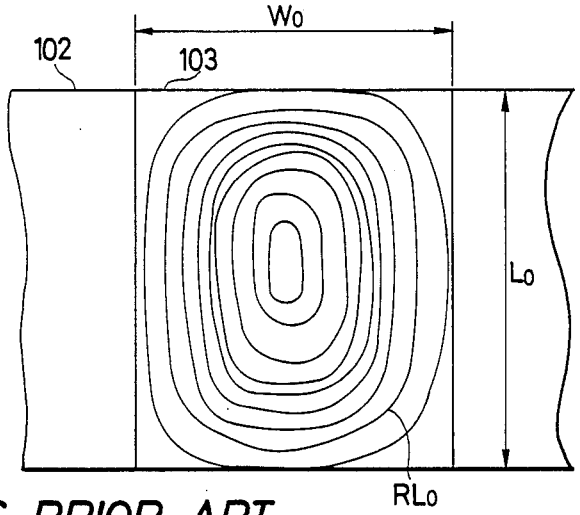
FIG. 15 PRIOR ART
FIG. 15 is an explanatory view showing isothermal curve lines of the heating resistor element of the thermal head according to prior art.
Figure 16:
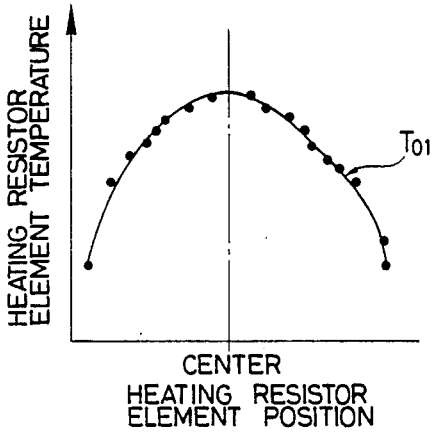
FIG. 16 PRIOR ART
FIG. 16 is a graph showing the relationship between the temperature of the heating resistor element and the position of the heating resistor element.

When a thermal head 50 having the analogous distribution curves of the graze portion temperature distribution $T_1$ and the graze portion face pressure distribution $P_1$ is used in the thermal transfer printer, the printing quality of the thermal transfer printer can be improved when compared with the prior art graze configuration such as are shown in FIGS. 13 and 14.

The face pressure of the graze portion 55 of the thermal head 50 is higher at the central portion or crown of the heating resistor element 52 than at the other portions. The heat resistance of the thermal head 50 has a small value. The heat emission from the heating resistor element 52 of the thermal head 50 to the ink ribbon 9 and the transfer recording paper 17 is therefore very effective.

As the face pressure of the graze portion 55 of the thermal head 50 decreases at the sides of the heating resistor element 52, the heat resistance of the thermal head 50 becomes larger. The heat emission from the resistor element 52 of the thermal head 50 to the ink ribbon 9 and the transfer recording paper 17 is reduced becomes worse.

Because the heat emission of the thermal head 50 is good at the high temperature region of the heating resistor element 52, and the heat emission is somewhat less in proportion to the temperature of the heating resistor element 52 as the temperature decreases, the ink, which is transferred from the ink ribbon 9 to the transfer recording paper 17, is cooled and solidified with greater uniformity and therefore without the ink void extending over substantially all of the heating resistor element 52. For want of required time for cooling at only the central portion of the heating resistor element 52, the ink re-transfer to the ink ribbon 9 does not occur.

Figure 10:
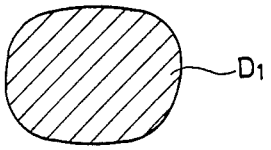
FIG. 10 is an enlarged view of a printed dot according to the present invention.

Accordingly, the thermal transfer without ink void can be obtained thereby to provide a printing dot $D_1$ as shown in FIG. 10.

Figure 17:
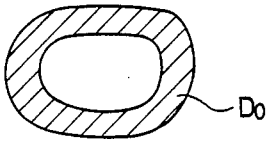
FIG. 17 PRIOR ART
FIG. 17 is a printing dot according to prior art.

The width ($W_2$) at the crown of the graze portion 55 of the heating resistor element 52 in this embodiment of the invention is about half of the width of the corresponding witdth ($W_o$) of the prior art as shown in FIG. 13. The printing dot $D_1$ (FIG. 10) in this embodiment of the invention is thus smaller and more compact then the prior art printing dot $D_o$ shown in FIG. 17. The printing dot $D_1$ (FIG. 10) flows rarely in the travelling direction of the thermal head 50.

The single head type thermal head 50 or the dual head type thermal head 60 is adapted for use with the thermal transfer printer having the ink ribbon 9. Such a single head type thermal head 50 or dual head type thermal head 60 can be also used with the thermal transfer printer having paper 17 that is heat sensitive. In such a thermal transfer printer with the heat sensitive paper, the heat resistance at the central portion of the heating resistor element 52 has a small value, and the heat emission performs thoroughly, so that the excessive heat discolor of the heat sensitive paper does not occur.

In above embodiment, the heating resistor element 52 of the thermal head 50 has an uniform heating value. The face pressure distribution $P_1$ of the graze portion 55 of the thermal head 50 has a shape that is similar to the shape of the temperature distribution curve $T_1$ of the graze portion 55 of the thermal head 50.

Figure 11:
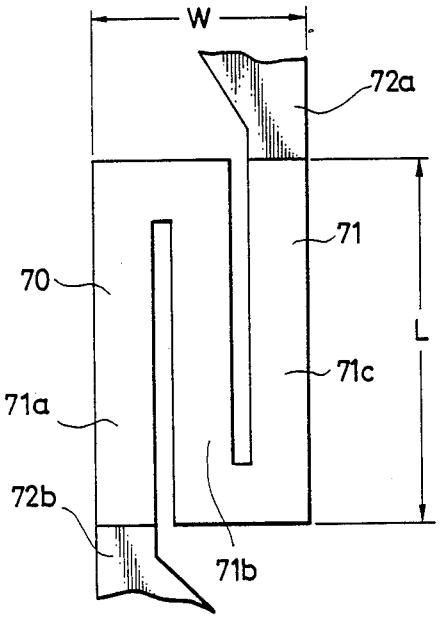
FIG. 11 is an enlarged elevation of a modified form of the thermal head according to the invention.

Another embodiment of the thermal head of the present invention will be explained referring to FIGS. 11 and 12. A heating resistor element 71 of a thermal head 70 as shown in FIG. 11. is mounted on a graze portion 55 similar to that shown in FIG. 8 and the heating resistor element 71 comprises three heating resistor portions 71*a*, 71*b* and 71*c*. The heating resistor element 71 is connected to lead wires 72*a* and 72*b*.

Figure 12:
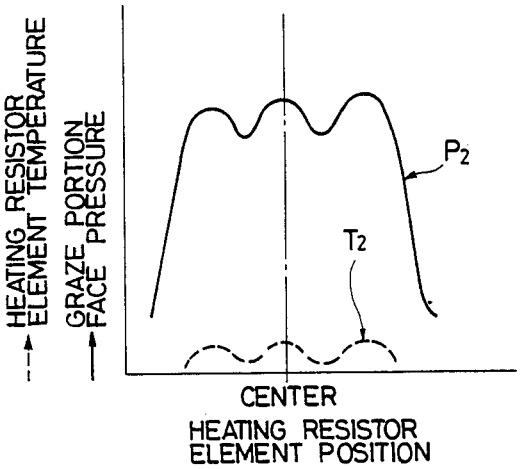
FIG. 12 includes graphs showing the temperature distribution and the face pressure distribution of the graze portion of the thermal head shown in FIG. 11 according to the present invention.

Since one heating resistor element 71 is divided into a plurality of the heating resistor portions 71*a*, 71*b* and 71*c*, the temperature distribution curve $T_2$ of the graze portion 55 for the thermal head 70 and the face pressure distribution curve $P_2$ of the graze portion 55 of the thermal head 70 have a much flatter appearance as shown in FIG. 12.

The curve $T_2$ of the temperature distribution of the graze portion 55 and the curve line $P_2$ of the face pressure distribution of the graze portion 55 have analogous or similar shapes respectively, so that the ink void caused by the ink re-transfer is omitted from the printing dot.

In this embodiment, the shape of the temperature distribution curve $T_2$ of the graze portion 55 of the thermal head 70 is similar to the shape of the face pressure distribution curve $P_2$ of the graze portion 55 of the thermal head 70.

When even heating of the resistor element 71 of the thermal head 70 at the central portion or crown of the graze portion 55 is used therein, it is possible to increase the printing quality of thermal head 70.

With respect to the analogous shapes of the temperature distribution and the face pressure distribution curves of the graze portion 55 of the thermal head 70, the description has been with regard to the horizontal direction (W direction) of the heater resistor element 71; however, the analogous shapes of the temperature and face pressure distribution curves $T_2$, $P_2$ of the graze portion 55 of the thermal head 70 may also be with regard to the lengthwise direction (L direction) of the heating resistor element 71.

We claim:

1. For use with a thermal transfer printer having a thermal head, a platen facing said thermal head, and a transfer recording paper for insertion between said thermal head and said platen so that printing is performed; said thermal head including a head substrate member, a graze portion formed projectingly on said head substrate member, and a heating resistor element formed on a crown portion of said graze portion wherein a temperature distribution curve of a surface of said heating resistor element of said thermal head when said thermal head is not pressed against a platen side and a face pressure distribution curve of the surface of said heating resistor element of said thermal head when said thermal head is pressed against the platen side have substantially analogous shapes within a range coextensive with said heating resistor element.

2. For use with a thermal transfer printer having a thermal head, a platen facing said thermal head, an ink ribbon coated with a thermal melting ink, and a transfer recording paper for insertion between said thermal head and said platen, so that printing is performed; said thermal head including a head substrate member, a graze portion formed projectingly on said head substrate member, and a heating resistor element formed on a crown portion of said graze portion wherein a face pressure distribution curve of a surface of said heating resistor element of said thermal head when said thermal head is pressed against a platen side has a shape substantially analogous, within a range coextensive with said heating resistor element, to a temperature distribution curve of the surface of said heating resistor element of said thermal head when said thermal head is not pressed against the platen side.

3. A thermal transfer printer according to claim 2, wherein said graze portion of said thermal head is formed of multistep projections, and said heating resistor element of said thermal head is provided on a crown of said graze portion of said thermal head.

4. A thermal transfer printer according to claim 2 wherein said graze portion of said thermal head is formed as a two step projection and said heating resistor element of said thermal head is provided on a crown of said graze portion of said thermal head.

5. A thermal transfer printer according to claim 3, wherein the crown of said graze portion of said thermal head has a width of about 100 μm.

6. A thermal transfer printer according to claim 4, wherein the crown of said graze portion of said thermal head has a width of about 100 μm.

* * * * *

UNITED STATES PATENT AND TRADEMARK OFFICE

CERTIFICATE OF CORRECTION

PATENT NO. : 4,840,500

DATED : June 20, 1989

INVENTOR(S) : Akira SASAKI, ET AL

It is certified that error appears in the above-identified patent and that said Letters Patent is hereby corrected as shown below:

Title page:

[73] Assignee: Hitachi, Ltd., Tokyo, Japan and Kyocera Corporation, Kyoto, Japan

Signed and Sealed this

Twelfth Day of June, 1990

*Attest:*

HARRY F. MANBECK, JR.

*Attesting Officer*

*Commissioner of Patents and Trademarks*